United States Patent [19]

Kikuchi et al.

[11] Patent Number: 4,932,845

[45] Date of Patent: Jun. 12, 1990

[54] SCROLL TYPE COMPRESSOR WITH LUBRICATION IN SUCTION CHAMBER HOUSING

[75] Inventors: Kazuto Kikuchi, Honjo; Shigemi Shimizu, Gunma, both of Japan

[73] Assignee: Sanden Corporation, Gunma, Japan

[21] Appl. No.: 271,872

[22] Filed: Nov. 16, 1988

Related U.S. Application Data

[63] Continuation-in-part of Ser. No. 240,627, Sep. 6, 1988.

[30] Foreign Application Priority Data

Nov. 21, 1987 [JP] Japan ..... 62-293122

[51] Int. Cl.[5] ..... F04B 39/02; F04C 18/04; F04C 29/02

[52] U.S. Cl. ..... 417/371; 418/55; 418/94; 418/100; 418/188

[58] Field of Search ..... 417/371, 372; 418/55 B, 418/55 D, 55 E, 88, 94, 100, 188

[56] References Cited

U.S. PATENT DOCUMENTS

| | | | |
|---|---|---|---|
| 2,835,436 | 5/1958 | Steinhagen et al. | 230/186 |
| 3,317,123 | 5/1967 | Funke | 418/88 |
| 3,833,318 | 9/1974 | Nakayama et al. | 418/100 |
| 3,838,942 | 10/1974 | Pokorny | 417/269 |
| 3,899,271 | 8/1975 | Glanvall | 418/82 |
| 3,945,765 | 3/1976 | Toyoda et al. | 417/269 |
| 3,986,799 | 10/1976 | McCullough | 418/55 |
| 4,005,948 | 2/1977 | Hiraga et al. | 417/269 |
| 4,065,279 | 12/1977 | McCullough | 62/510 |
| 4,314,796 | 2/1982 | Terauchi | 417/294 |
| 4,332,535 | 6/1982 | Terauchi et al. | 418/55 |
| 4,340,339 | 7/1982 | Hiraga et al. | 418/55 |
| 4,343,599 | 8/1982 | Kousokabe | 418/55 |
| 4,365,941 | 12/1982 | Tojo et al. | 418/55 D |
| 4,396,364 | 8/1983 | Tojo et al. | 418/55 |
| 4,527,963 | 7/1985 | Terauchi | 418/55 |
| 4,538,975 | 9/1985 | Tsukagoshi | 418/55 |
| 4,547,138 | 10/1985 | Mabe et al. | 418/55 |
| 4,560,330 | 12/1985 | Murayama et al. | 418/55 |
| 4,561,832 | 12/1985 | Shimizu | 418/55 |
| 4,564,339 | 1/1986 | Nakamura | 417/366 |
| 4,666,381 | 5/1987 | Butterworth | 418/55 E |
| 4,767,293 | 8/1988 | Caillat et al. | 418/55 B |

FOREIGN PATENT DOCUMENTS

| | | | |
|---|---|---|---|
| 168560 | 4/1985 | European Pat. Off. . | |
| 54-139107 | 10/1979 | Japan . | |
| 55-60685 | 5/1980 | Japan | 418/55 E |
| 56-156490 | 12/1981 | Japan . | |
| 58-165589 | 1/1984 | Japan . | |
| 60-93192 | 5/1985 | Japan | 418/55 E |
| 62-168986 | 7/1987 | Japan | 418/55 E |

*Primary Examiner*—John J. Vrablik

*Attorney, Agent, or Firm*—Banner, Birch, McKie & Beckett

[57] ABSTRACT

This invention discloses a lubricating mechanism of a hermetically sealed scroll type compressor in which an inner chamber of a housing is kept at suction pressure. The compressor includes a drive shaft supported by a first plain bearing in an inner block member. The drive shaft is operatively linked to an orbiting scroll which orbits within a stationary scroll. A rotation preventing device prevents rotation of the orbiting scroll. The drive shaft includes an axial bore extending from an open end and terminating within the inner block member. A pin extends from the end of the drive shaft to the orbital scroll and is supported in a bushing within an extension of the orbiting scroll. A second plain bearing supports the bushing. A passage links the axial bore to an opening at the end of the pin facing the orbital scroll. A radial bore is provided near the terminal end of the axial bore to link the axial bore to a suction chamber of the compressor. A first helical groove is formed in the exterior surface of the supported portion of the drive shaft. The first helical groove is linked to the axial bore through a radial hole formed through the supported portion of the drive shaft. A second helical groove is formed in the exterior surface of the bushing. Fluid flows through the radial bore and through the narrow passage to lubricate the rotation preventing device. Fluid flows through the first helical groove to lubricate the friction surface between the drive shaft and the first plain bearing. Fluid flow through the second helical groove to lubricate the surface between the bushing and the second plain bearing.

18 Claims, 2 Drawing Sheets

SCROLL TYPE COMPRESSOR WITH LUBRICATION IN SUCTION CHAMBER HOUSING

BACKGROUND OF THE INVENTION

This application is a continuation-in-part application of application Ser. No. 240,627 filed Sept. 6, 1988.

FIELD OF THE INVENTION

This invention relates to a scroll type compressor, and more particularly, to a lubricating mechanism for a hermetically sealed scroll type compressor.

DESCRIPTION OF THE PRIOR ART

A hermetically sealed scroll type compressor is disclosed in Japanese Patent Application Publication No. 61-87994 and is shown in FIG. 1. A hermetically sealed housing includes inner chamber 1 which is maintained at discharge pressure. The compression mechanism, including interfitting scrolls 2 and 3 and the forward end of the drive mechanism including drive shaft 130, is isolated from inner chamber 1 behind partition 110. Channel 5 links intermediate pocket 6 of the interfitting scrolls 2 and 3 which chamber 7. Refrigerant gas flows through inlet port 850 and is compressed inwardly by scrolls 2 and 3 towards central pocket 700, and flows to discharge chamber 500 through hole 240 and eventually outlet port 860 to an external element of the refrigeration system. Some of the refriferant gas also flows to inner chamber 1.

The intermediate pressure in pocket 6 is maintained in chamber 7 which contains the forward end of the drive mechanism including bearings 141–143. When the compressor operates, lubricating oil mixed with the refrigerant gas, which settles at the bottom of inner chamber 1, flows through channel 8 to lubricate bearings 141–143 of the drive mechanism due to the pressure difference between inner chamber 1, which is maintained at the discharge pressure, and the intermediate pressure.

However, it is difficult to utilize the above type lubricating mechanism in a hermetically sealed scroll type compressor in which the inner chamber is maintained at the suction pressure. Since the suction pressure is lower than the discharge pressure and the intermediate pressure, the lubricating fluid will not flow to the drive mechanism in this type of compressor.

SUMMARY OF THE INVENTION

It is a primary object of this invention to provide an effective and simplified lubricating mechanism for use in a hermetically sealed scroll type compressor in which an inner chamber of the hermetically sealed housing is maintained at suction pressure.

A compressor according to this invention includes a fixed scroll and an orbiting scroll disposed within a hermetically sealed housing. The fixed scroll includes a first end plate from which a first wrap or spiral element extends into the interior of the housing. The end plate of the fixed scroll divides the housing into a discharge chamber and a suction chamber. The first spiral element is located in the suction chamber. An orbiting scroll includes a second end plate from which a second wrap or spiral element extends. The first and second spiral elements interfit at an angular and radial offset to form a plurality of line contacts which define at least one pair of sealed off fluid pockets.

A drive mechanism includes a motor supported in the housing. The drive mechanism is operatively connected to the orbiting scroll to effect orbital motion thereof. A rotation preventing device prevents the rotation of the orbiting scroll during orbital motion so that the volume of the fluid pockets changes to compress refrigerant gas in the pockets inwardly from the outermost pocket towards the central pocket. The compressed gas flows out of the central pocket through a channel in the end plate of the fixed scroll and into a discharge chamber.

The drive mechanism also includes a drive shaft rotatably supported within an inner block member through a fixed plain bearing. The inner block member is fixedly secured to the housing and divides the suction chamber into a first suction chamber section and a second suction chamber section which includes the rotation preventing device. An axial bore is formed within the drive shaft and is linked to at least one radial bore extending through the drive shaft and leading to the first suction chamber section. One end of the drive shaft includes an open end of the axial bore and is located in close proximity to the inlet of the compressor. The other end of the drive shaft extends into a projecting pin forward of the location where the axial bore terminates within the drive shaft. At least one radial hole is formed through a supported portion of the drive shaft and is linked to the axial bore. At least one helical groove is formed in the exterior suface of the drive shaft and is linked to the radial hole.

The terminal end of the axial bore is linked to a narrow offset passage extending through the projecting pin and opening into a gap adjacent the end plate of the orbiting scroll. The projecting pin extends through a bushing located within an annular projection of the orbiting scroll. A second fixed plain bearing is disposed at an exterior peripheral surface of the bushing. The second bearing supports the bushing within the annular projection extending from the end plate of the orbital scroll. At least one helical groove is formed in the exterior surface of the bushing.

In operation, the refrigerant gas includes a lubricating fluid which flows from the axial bore toward the radial bores and the offset channel. The fluid lubricates the first plain bearing supporting the drive shaft, the bushing and the second plain bearing, as well as the rotation preventing device located forward of the drive shaft.

Further objects, features and other aspects of this invention will be understood from the detailed description of the preferred embodiment of this invention with reference to the annexed drawings.

DETAILED DESCRIPTION OF THE PREFERRED EMBODIMENT

Figure 1:
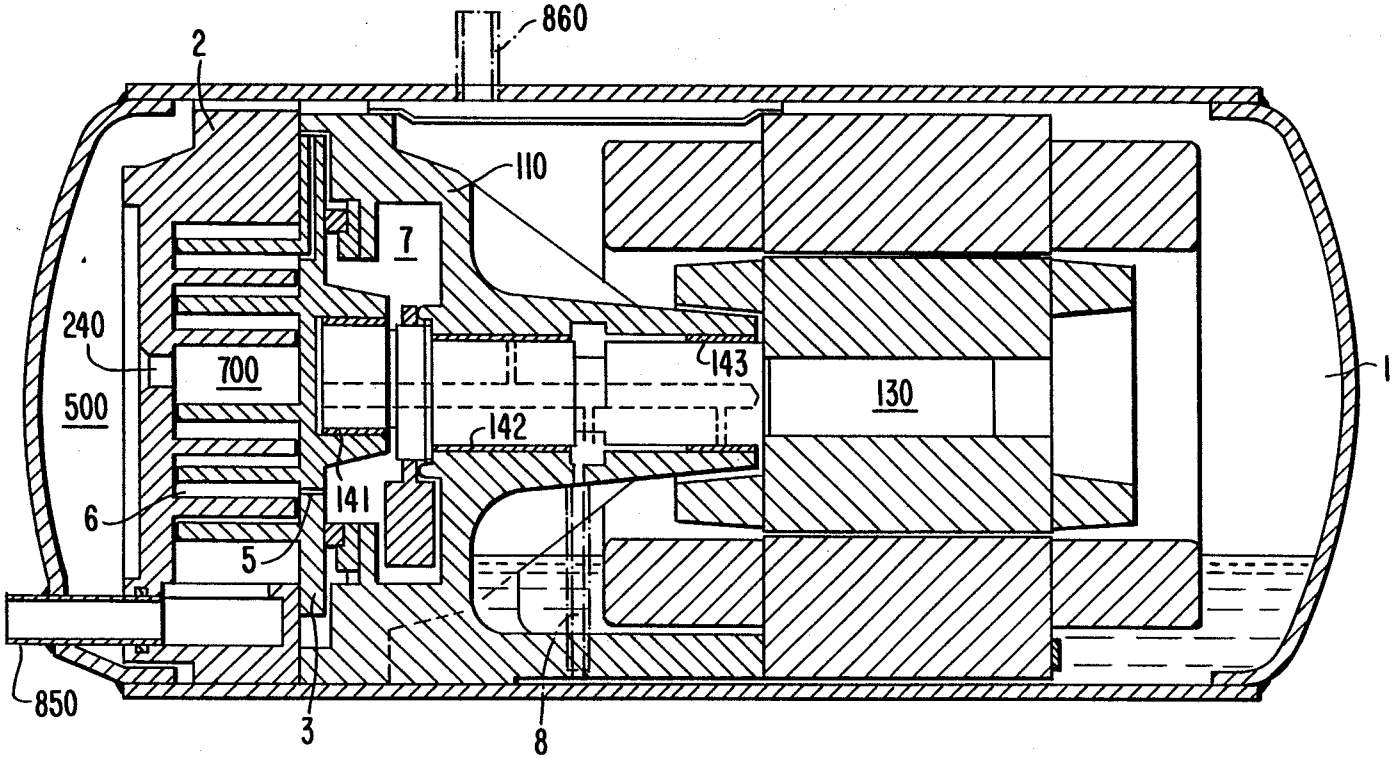
FIG. 1 PRIOR ART
FIG. 1 is a vertical longitudinal section of a scroll type compressor in accordance with the prior art.
Figure 2:
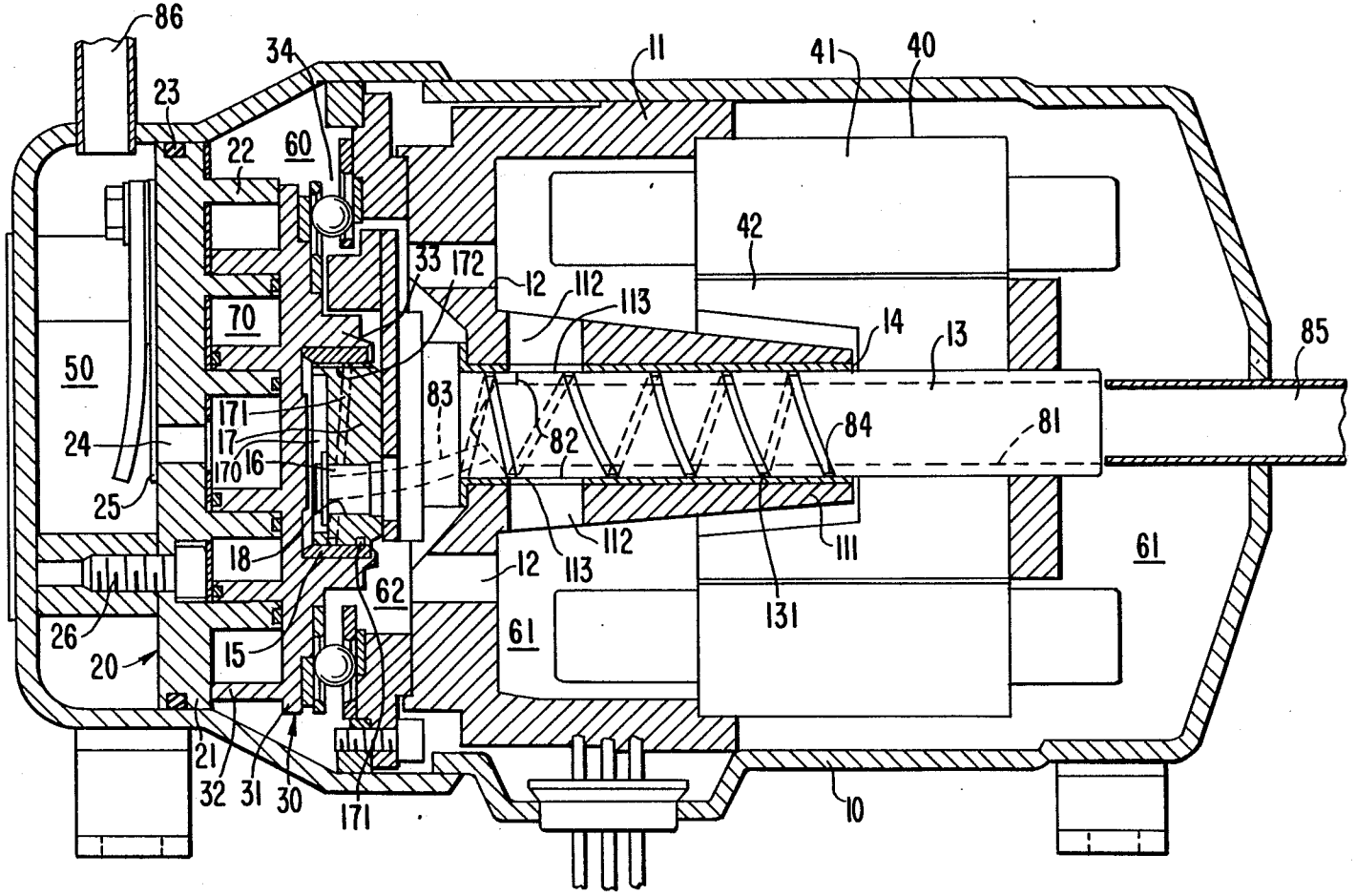
FIG. 2 is a vertical longitudinal section of a hermetically sealed scroll type compressor in accordance with this invention.

Referring to FIG. 2, a hermetically sealed scroll type compressor in accordance with one embodiment of the present invention is shown. For purposes of explanation only, the left side of the Figure will be referenced as the forward end or front and the right side of the Figure will be referenced as the rearward end. The compressor includes hermetically sealed casing 10, fixed and orbiting scrolls 20, 30 and motor 40. Fixed scroll 20 includes circular end plate 21 and spiral element or wrap 22 extending from one end (rearward) surface thereof. Fixed scroll 20 is fixedly disposed within a front end portion of casing 10 by a plurality of screws 26. Circular end plate 21 of fixed scroll 20 partitions an inner chamber of casing 10 into two chambers, for example, discharge chamber 50 and suction chamber 60. O-ring seal 23 is disposed between an inner peripheral surface of casing 10 and an exterior peripheral surface of circular end plate 21 to seal the mating surfaces of casing 10 and circular end plate 21.

Orbiting scroll 30 is disposed within suction chamber 60 and includes circular end plate 31 and spiral element or wrap 32 extending from one end (forward) surface of circular end plate 31. Spiral element 22 of fixed scroll 20 and spiral element 32 of orbiting scroll 30 interfit at an angular and radial offset to form a plurality of line contacts which define at least one pair of sealed off fluid pockets 70. Axial annular projection 33 is formed at the rearward end surface of circular end plate 31 opposite spiral element 32. Rotation preventing device 34 is disposed on the outer circumferential surface of annular projection 33 to prevent rotation of orbiting scroll 30 during orbital motion.

Inner block member 11 secures stator 41 of motor 40 and is fixedly disposed within suction chamber 60. Inner block member 11 divides suction chamber 60 into first suction chamber section 61 on its rearward side and second suction chamber section 62 on its forward side. Rotation preventing device 34 is located forward of inner block member 11 in second suction chamber section 62. A plurality of communication holes 12 are axially formed through inner block member 11 and link first and second suction chamber sections 61 and 62. Axial annular projection 111 extends from a central region of the rearward end surface of inner block member 11. Drive shaft 13 is rotatably supported within axial annular projection 111 through first fixed plain bearing 14. Drive shaft 13 extends through the center of inner block member 11 and is supported within it through first fixed plain bearing 14.

Motor 40 also includes rotor 42 fixedly secured to an exterior peripheral surface of drive shaft 13. Pin member 16 is integral with and axially projects from the forward end surface of drive shaft 13 and is radially offset from the axis of drive shaft 13. Bushing 17 is rotatably disposed within axial annular projection 33 and is supported through second fixed plain bearing 15. Pin member 16 is inserted in hole 18 of bushing 17 which is offset rom the center of bushing 17. Gap 170 is located within projection 33, between the end of bushing 17 and circular end plate 31. Gap 172 is located between the exterior surface of bushing 17 and second plain bearing 15.

Drive shaft 13 is provided with axial bore 81 and a plurality of radial bores 82. Axial bore 81 extends from an opening at a first (rearward) end of drive shaft 13, that is, the end opposite pin member 16, to a closed end rearward of pin member 16. Narrow offset passage 83 links the forward closed end of axial bore 81 to an open end surface of pin member 16 adjacent orbiting scroll 30. The plurality of radial bores 82 link axial bore 81 near its closed end to first suction chamber section 61 through a plurality of communication holes 112 formed in axial annular projection 111 and corresponding holes 113 in fixed plain bearing 114. Suction gas inlet pipe 85 is inserted through the rear end of casing 10 and faces the opening of axial bore 81. Discharge gas outlet pipe 86 is attached to a side wall of casing 10 and links discharge chamber 50 to an external element.

At least one radial hole 84 is linked to axial bore 81 and is formed through drive shaft 13 at a location near the end of annular projection 111. At least one helical proove 131 is formed on the exterior surface of the drive shaft 13 and is linked to radial hole 84. Helical groove 171 is formed on the exterior surface of bushing 17 adjacent the inner surface of second plain bearing 15. Helical groove 171 is adjacent gap 172.

In operation, stator 41 generates a magnetic field causing rotation of rotor 42, thereby rotating drive shaft 13. This rotation is converted to orbital motion of orbiting scroll 30 through bushing 17; rotational motion is prevented by rotation preventing device 34. Refrigerant gas introduced into suction chamber 60 through suction gas inlet pipe 85 is taken into the outer sealed fluid pockets 70 between fixed scroll 20 and orbiting scroll 30, and moves inwardly towards the center of spiral elements 22, 32 due to the orbital motion of orbiting scroll 30. As the refrigerant moves towards the central pocket, it undergoes a resultant volume reduction and compression, and is discharged to discharge chamber 50 through discharge port 24 and one-way valve 25. Discharge gas in discharge chamber 50 then flows to an external fluid circuit (not shown) through discharge gas outlet pipe 86.

The lubricating mechanism of the invention operates as follows. Refrigerant gas including lubricating oil (jointly denoted refrigerant gas, hereinafter) is introduced into suction chamber 60 from suction gas inlet pipe 85, and is largely taken into axial bore 81. A large part of the refrigerant gas flows out of axial bore 81, and into first suction chamber section 61 through radial bores 82 and communication holes 112 and holes 13, and then flows through communication holes 12 into second suction chamber section 62, rearward of rotation preventing device 34. Part of the remainder of the refrigerant gas in axial bore 81 flows through narrow offset passage 83 and into gap 170 between bushing 17 and circular end plate 31. This gas then flows through gap 172 between bushing 17 and second plain bearing 15, and into second suction chamber section 62. Subsequently, the refrigerant gas in second suction chamber section 62 flows through and lubricates rotation preventing device 34, before being taken into sealed fluid pockets 70.

Furthermore, a part of the refrigerant gas which is in axial bore 81 flows into helical groove 131 through radial hole 84 to lubricate the friction surface between drive shaft 13 and first plain bearing 14. Similarly, part of the gas which flows through gap 172 between bushing 17 and second plain bearing 15 flows into helical groove 171 to lubricate the friction surface between bushing 17 and second plain bearing 15.

Thus, the refrigerant gas effectively lubricates the friction surface between drive shaft 13 and first plain bearing 14, the friction surface between bushing 17 and second plain bearing 15, and rotation preventing device 34. Additionally, some lubricant oil is partially separated from the refrigerant gas and settles beneath orbiting scroll 30, while some of the lubricant oil is taken into sealed fluid pockets 70 as a mist due to orbital motion of orbiting scroll 30 and lubricates the contact surface of the scrolls.

This invention has been described in detail in connection with the preferred embodiment. This embodiment, however, is merely for example only and the invention is not restricted thereto. It will be understood by those skilled in the art that other variations and modifications can easily be made within the scope of this invention as defind by the appended claims.

We claim:

1. In a scroll type compressor with a hermetically sealed housing, the compressor comprising a fixed scroll disposed within said housing, said fixed scroll having a first end plate and a first spiral element extending therefrom, said first end plate of said fixed scroll dividing said housing into a discharge chamber and a suction chamber into which said first spiral element extends, an orbiting scroll having a second end plate from which a second spiral element extends, said first end late from which a second spiral element extends, said first and second spiral elements interfitting at an angular and radial offset to form a plurality of line contacts which define at least one pair of sealed off fluid pockets, a drive mechanism operatively connected to said orbiting scroll to effect orbital motion of said orbiting scroll, a rotation preventing means for preventing the rotation of said orbiting scroll during orbital motion whereby the volume of said fluid pockets changes to compress refrigerant gas entering said suction chamber in said pockets, said drive mechanism including a drive shaft rotatably supported within an inner block member, said inner block member fixedly secured to said housing, the improvement comprising:

a first plain bearing disposed between an interior surface of said inner block member and an exterior surface of said drive shaft, said drive shaft having an axial bore and at least one radial hole extending through its exterior surface linked to said axial bore, and at least a first helical groove formed on said exterior surface of said drive shaft and linked to said radial hole, wherein the refrigerant gas entering said suction chamber is mixed with lubricating oil and a portion of said mixed refrigerant gas and lubricating oil flows through said axial bore, and into said helical groove by said at least one radial hole to lubricate the contact surface between said first plain bearing and said drive shaft.

2. The sealed scroll type compressor of claim 1, said inner block member comprising a first axial annular projection extending therefrom, said first plain bearing disposed between an interior surface of said first axial annular projection and an exterior surface of said drive shaft.

3. The sealed scroll type compressor of claim 2, said axial bore of said drive shaft extending from an opening at one end of said drive shaft to a closed end near an opposite end of said drive shaft.

4. The sealed scroll type compressor of claim 3 further comprising, an integral pin member disposed at said opposite end of said drive shaft, said pin member radially offset with respect to the axis of said drive shaft, said pin member operatively connected to said orbiting scroll through a bushing in which said pin member is located, said bushing disposed within a second axial annular projection extending from said second end plate of said orbiting scroll, and a narrow passage formed from said closed end of said axial bore to an end surface of said pin member facing said second end plate.

5. The sealed scroll type compressor of claim 4 further comprising, a second plain bearing disposed between an interior surface of said second axial annular projection and an exterior surface of said bushing, and a second helical groove formed in said exterior surface of said bushing.

6. The sealed scroll type compressor of claim 3, said housing provided with a refrigerant gas inlet port extending therethrough and terminating near said opening of said axial bore.

7. The sealed scroll type compressor of claim 3, said drive shaft comprising at least one radial bore extending therethrough linking said axial bore near its closed end to said suction chamber.

8. The sealed scroll type compressor of claim 2, said radial hole formed near the end of said first axial annular projection, said first helical groove extending from said radial hole along the entire length of drive shaft supported in said inner block member.

9. The sealed scroll type compressor of claim 1, said inner block member dividing said suction chamber into a first suction chamber section and a second suction chamber section, said rotation preventing means located in said second suction chamber section.

10. The sealed scroll type compressor of claim 9 further comprising at least one communicating hole linking said first and second suction chamber sections, said communication hole formed through said inner block member.

11. The sealed scroll type compressor of claim 5, said inner block member dividing said suction chamber into a first suction chamber section and a second suction chamber section, said compressor further comprising a first gap formed between said end surface of said pin member and said orbiting scroll, and a second gap formed between said bushing and said second plain bearing, said second gap linking said first gap with said second suction chamber section and with said second helical groove adjacent said second gap.

12. In a scroll type compressor with a hermetically sealed housing, the compressor comprising a fixed scroll disposed within said housing, said fixed scroll having a first end plate and a first spiral element extending therefrom, said first end plate of said fixed scroll dividing said housing into a discharge chamber and a suction chamber into which said first spiral element extends, an orbiting scroll having a second end plate from which a second spiral element extends, said first and second spiral elements interfitting at an angular and radial offset to form a plurality of line contacts which define at least one pair of sealed off fluid pockets, a drive mechanism operatively connected to said orbiting scroll to effect orbital motion of said orbiting scroll, a rotation preventing means for preventing the rotation of said orbiting scroll during orbital motion whereby the volume of said fluid pockets changes to compress fluid in said pockets, said drive mechanism including a drive shaft rotatably supported within an inner block member, said inner block member fixedly secured to said housing, the improvement comprising:

said drive shaft having an axial bore extending from an opening at one end of said drive shaft to a closed end near an opposite end of said drive shaft, an integral pin member disposed at said opposite end of said drive shaft, said pin member operatively connected to said orbiting scroll through a bushing in which said pin member is located, said bushing disposed within an axial annular projection extending from said second end plate of said orbiting scroll, a narrow passage formed from said closed end of said axial bore to an end surface of said pin member facing said orbiting scroll, a first gap formed between said end surface of said pin member and said orbiting scroll, a plain bearing disposed between an interior surface of said axial annular projection and an exterior surface of said bushing, a helical groove formed in said exterior surface of said bushing and linked to said suction chamber, and a second gap formed between said bushing and said plain bearing linking said first gap to said suction chamber.

13. The sealed scroll type compressor of claim 12, said pin member radially offset with respect to the axis of said drive shaft.

14. The sealed scroll type compressor of claim 12, said inner block member dividing said suction chamber into a first suction chamber section and a second suction chamber section, said second gap linking said first gap to said second suction chamber section.

15. In a scroll type compressor with a hermetically sealed housing, the compressor comprising a fixed scroll disposed within said housing, said fixed scroll having a first end plate and a first spiral element extending therefrom, said first end plate of said fixed scroll dividing said housing into a discharge chamber and a suction chamber into which said first spiral element extends, an orbiting scroll having a second end plate from which a second spiral element extends, said first and second spiral elements interfitting at an angular and radial offset to form a plurality of line contacts which define at least one pair of sealed off fluid pockets, a drive mechanism operatively connected to said orbiting scroll to effect orbital motion of said orbiting scroll, a rotation preventing means for preventing the rotation of said orbiting scroll during orbital motion whereby the volume of said fluid pockets changes to compress refrigerant gas in said pockets, said drive mechanism including a drive shaft rotatably supported within an inner block member, said inner block member fixedly secured to said housing, the improvement comprising:

said drive shaft having an axial bore and at least one radial hole extending through its exterior surface linked to said axial bore, and at least a first helical groove formed on said exterior surface of said drive shaft and linked to said radial hole, said axial bore of said drive shaft extending from an opening at one end of said drive shaft to a closed end near an opposite end of said drive shaft, said housing including a refrigerant gas inlet pipe extending therethrough and terminating near said opening of said axial bore such that a portion of the refrigerant gas entering said compressor through said refrigerant gas inlet pipe flows through said axial bore of said drive shaft.

16. In a scroll type compressor with a hermetically sealed housing, the compressor comprising a fixed scroll disposed within said housing, said fixed scroll having a first end plate and a first spiral element extending therefrom, said first end plate of said fixed scroll dividing said housing into a discharge chamber and a suction chamber into which said first spiral element extends, an orbiting scroll having a second end plate from which a second spiral element extends, said first and second spiral elements interfitting at an angular and radial offset to form a plurality of line contacts which define at least one pair of sealed off fluid pockets, a drive mechanism operatively connected to said orbiting scroll to effect orbital motion of said orbiting scroll, a rotation preventing means for preventing the rotation of said orbiting scroll during orbital motion whereby the volume of said fluid pockets changes to compress refrigerant gas in said pockets, said drive mechanism including a drive shaft rotatably supported within an inner block member, said inner block member fixedly secured to said housing, the improvement comprising:

said drive shaft having an axial bore extending from an opening at one end of said drive shaft to a closed end near an opposite end of said drive shaft, an integral pin member disposed at said opposite end of said drive shaft, said pin member radially offset with respect to the axis of said drive shaft, said pin member operatively connected to said orbiting scroll through a bushing in which said pin member is located, said bushing disposed within an axial annular projection extending from said second end plate of said orbiting scroll, a narrow passage formed through said pin member from said closed end of said axial bore to an end surface of said pin member facing said second end plate, a plain bearing disposed between an interior surface of said axial annular projection and an exterior surface of said bushing, and a first helical groove formed in said exterior surface of said bushing.

17. The compressor recited in claim 16 further comprising a refrigerant gas inlet pipe extending through said housing and terminating near said opening of said axial bore such that a portion of the refrigerant gas entering said compressor through said refrigerant gas inlet pipe flows through said axial bore of said drive shaft and into said helical groove.

18. The compressor recited in claim 17 said drive shaft further comprising at least one radial hole extending through its exterior surface and linked to said axial bore, and a second helical groove formed on said exterior surface of said drive shaft and linked to said radial hole.

* * * * *